United States Patent [19]

Kayanuma

[11] 4,059,081

[45] Nov. 22, 1977

[54] EVAP SYSTEM-PROVIDED THROTTLE VALVE CONTROL UNIT

[75] Inventor: Nobuaki Kayanuma, Toyota, Japan

[73] Assignee: Toyota Jidosha Kogyo Kabushiki Kaisha, Japan

[21] Appl. No.: 652,320

[22] Filed: Jan. 26, 1976

[30] Foreign Application Priority Data

Oct. 7, 1975 Japan ..... 50-120250

[51] Int. Cl.[2] ..... F02M 59/00

[52] U.S. Cl. ..... 123/136; 123/97 B; 60/278

[58] Field of Search ..... 60/278; 123/97 B, 136

[56] References Cited

U.S. PATENT DOCUMENTS

| | | | |
|---|---|---|---|
| 3,523,418 | 8/1970 | Marsee | 123/97 B |
| 3,683,597 | 8/1972 | Beveridge et al. | 123/136 |
| 3,690,307 | 9/1972 | O'Neill | 123/136 |
| 3,796,049 | 3/1974 | Hayashi | 60/278 |
| 3,913,545 | 10/1975 | Haase et al. | 123/136 |
| 3,962,868 | 6/1976 | Matuomoto et al. | 60/278 |

*Primary Examiner*—Martin P. Schwadron
*Assistant Examiner*—G. L. Walton
*Attorney, Agent, or Firm*—Stevens, Davis, Miller & Mosher

[57] ABSTRACT

An EVAP system-provided throttle valve control unit comprising a pressure-operative throttle positioner for opening and closing a throttle valve, said positioner being always connected to an intake pipe or an intake manifold, a pressure control valve device arranged to open and close according to the discharge pressure of an air pump for the re-combustion of exhaust gas, said positioner being connected to a purge hose from a charcoal canister through said device, and a fuel evaporative emission control system arranged so that when the discharge pressure of said air pump is lower than a prescribed value, said device is opened to connect the positioner to the pressure in said purge hose.

5 Claims, 3 Drawing Figures

EVAP SYSTEM-PROVIDED THROTTLE VALVE CONTROL UNIT

The present invention relates to a control unit for controlling both a fuel evaporative emission control system (EVAP system) and a throttle positioner for opening and closing a throttle valve by utilizing an air pump disposed for the re-combustion of exhaust gas. It is known in the art to provide a throttle positioner which is connected to an intake pipe or intake manifold through a vacuum control valve actuated in response to a discharge pressure of an air pump for feeding secondary air to an air injection system of a re-combustion device for exhaust gas and which is actuated on sensing negative pressure in the intake pipe or intake manifold. When an accelerator pedal is suddenly released to reduce the speed or to apply the brakes of an engine, the throttle valve is closed to its idle position and a risk or misfire in the engine occurs. The above known throttle positioner was developed as means for forcibly opening the throttle valve slightly when the discharge pressure of the air pump is higher than a prescribed value even when the accelerator pedal is released.

In order to prevent a vapor generated from fuel in the fuel tank of an engine from being discharged into the air as it is (i.e. to for prevent air pollution), this fuel vapor is introduced into a charcoal (active carbon) canister to adsorb the active carbon, and when the RPMs of the engine exceeds a prescribed limit, air (purged air) is taken in from an opening in the bottom of said charcoal canister. While this purged air rises in said canister, it desorbs said adsorbed vapor from the active carbon and discharges it little by little into the intake pipe or intake manifold via a purge hose so as to incorporate it into an air-fuel mixture from the carburetor. This system for discharging fuel vapor into the intake pipe or intake manifold together with purged air is generally called an "EVAP system". According to the known EVAP system, the vehicle speed or the throttle opening is detected as a parameter independently from the above-mentioned throttle positioner, and a vacuum switching valve mounted in the purge hose is controlled in response to said detected parameter to actuate the EVAP system. Therefore, in this conventional EVAP system, a provision for a detecting means, for example, a speed sensor detecting the vehicle speed and a computor transmitting signals to the vacuum control valve or shutting them off from the vacuum control valve, is indispensable.

It is therefore a primary object of the present invention to provide a novel control unit having a simple structure in which the control of the EVAP system and the throttle positioner is simultaneously performed by a single pressure control valve device thereby dispensing with the need for the above-mentioned speed sensor, a computor and the like.

The above discussed and other objects, features and advantages of the present invention will become more apparent from the following description thereof, when taken in conjunction with the accompanying drawings, in which.

Figure 1:
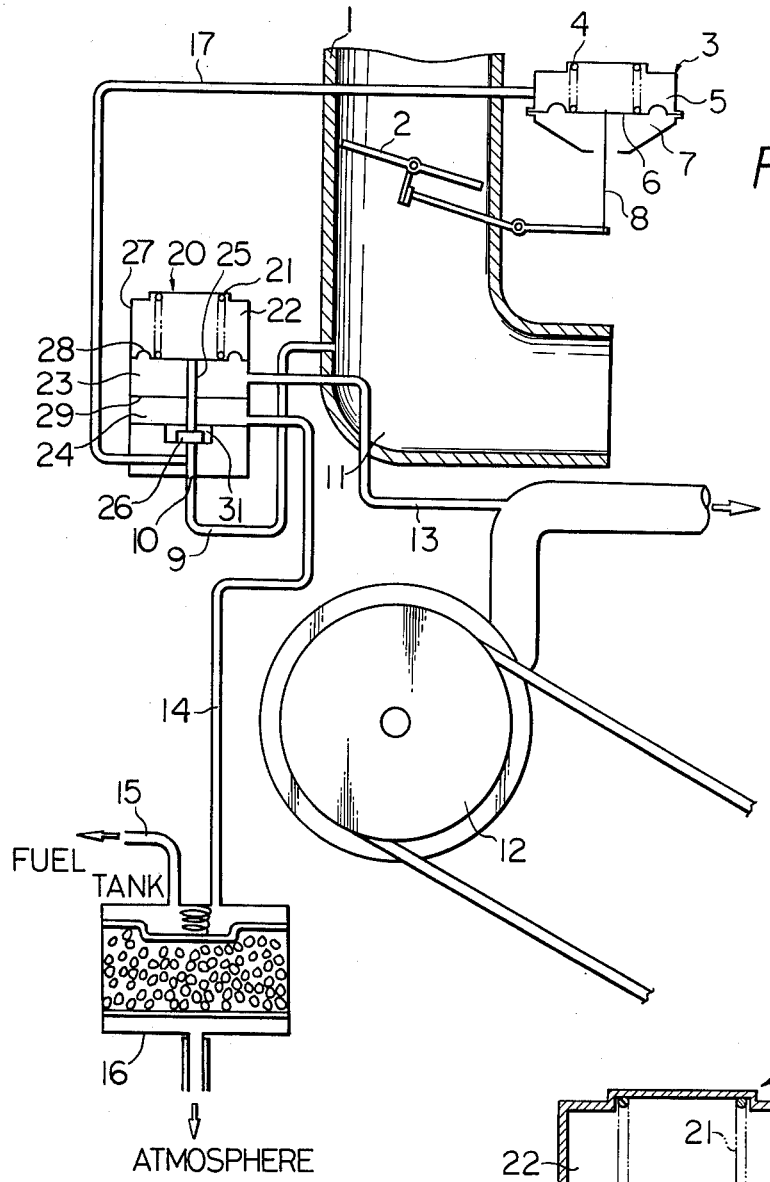
FIG. 1 is a diagram illustrating the EVAP system-provided throttle valve control unit of the present invention.
Figure 2:
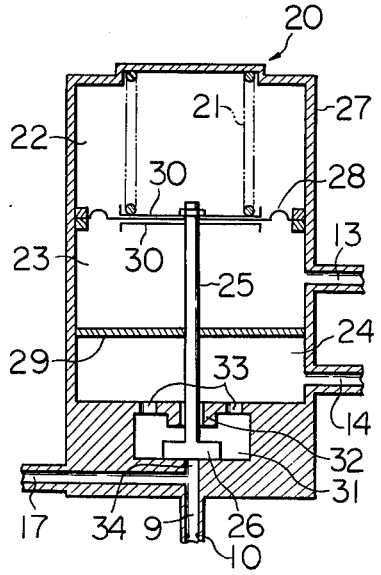
FIG. 2 is an enlarged sectional view of the pressure control valve device of the unit shown in FIG. 1.

Referring now to FIGS. 1 and 2 which diagrammatically illustrate the EVAP system-provided throttle valve control unit of the present invention, a throttle valve 2 in a carburetor 1 is connected to an operation rod 8 of a throttle positioner 3 through a lever mechanism. Said throttle positioner 3 is divided into two chambers 5 and 7 by a diaphragm 6. In the pressure-operated chamber 5, a spring 4 is disposed to press said diaphragm 6 toward said chamber 7 which is open to the air. The pressure-operated chamber 5 is connected through a conduit 17 to a pressure control valve device 20 which will now be described.

As illustrated in detail in FIG. 2, said pressure control valve device 20 according to the present invention is divided into three chambers 22, 23 and 24 by a diaphragm 28 and a partition wall 29. These chambers are not connected to one another, and a spring 21 is disposed in said chamber 22 to press diaphragm 28 toward chamber 23. Chamber 22 is maintained at, for example, atmospheric pressure. Chamber 23 is connected to an air pump provided for the re-combustion of the exhaust gas through a conduit 13 to form a pressure chamber. Said chamber 24 is connected to a charcoal canister 16 through a purge hose 14. An operation rod 25 is fixed to the diaphragm 28 through a retainer 30, and this operation rod 25 extends through the partition wall 29 and the chamber 24 and projects into a valve chamber 31 mounted on the bottom of said chamber 24. A valve head portion 26 is formed on the top end of the operation rod 25 and when the pressure control valve device 20 is not actuated, this valve head portion 26 is engaged with the bottom face of the valve chamber 31 to close a valve port 34. A bellows or the like may be mounted on the partition wall 29 so that the operation rod 25 is allowed to make a vertical movement in the sealed state, or a diaphragm having a higher rigidity than the diaphragm 28 may be used as the partition wall 29. Said valve chamber 31 is connected to the chamber 24 through at least one opening 33 (2 openings are shown in the drawings). The conduit 17 from the throttle positioner 3 is connected in the vicinity of the valve port 34 to a conduit 9 which is connected to an intake pipe 11 or intake manifold. Accordingly, the chamber 5 of the throttle positioner 3 is always connected to said intake pipe 11 through these conduits 17 and 9. It is preferred that the conduit 9 be provided with a contracted portion 10, the reason for which will now be described.

As is well-known in the art, the charcoal canister 16 adsorbs fuel vapor from a fuel tank (not shown) through active carbon stored therein before the RPMs of the engine arrives at a prescribed value (in the present invention, before the discharge pressure of the air pump 12 arrives at a prescribed value), and after the RPMs has reached said prescribed value, air is sucked from an air introduction inlet formed in the bottom portion of the charcoal canister 16 and the adsorbed fuel vapor is desorbed by the thus sucked air and discharged into the intake pipe 11 through the purge hose 14 (at this point, the valve 26 is opened as described hereinafter).

The control unit of the present invention having the above structure is operated in the following manner.

Since the discharge pressure of the air pump 12 is in direct proportion to the engine speed, when the discharge pressure of the pump 12 is lower than a prescribed value, for example, 80 mmHg, namely when the vehicle velocity is low, the pressure in the pressure chamber 23 is not high enough to push the diaphragm 28 up against the spring 21. Accordingly, the valve head 26 on the bottom end of the operation rod 25 is engaged with the lower face of the valve chamber 31, and the valve port 34 is closed. Therefore, no purged air is brought from the charcoal canister. In other words, the EVAP system is kept in the "off" state. At this point, since the pressure-operated chamber 5 is connected to the intake pipe 11 through the conduits 17 and 9 as illustrated hereinbefore, the pressure in the chamber 5 corresponds to the inner pressure of the intake pipe 11, namely negative pressure. Accordingly, the diaphragm 6 is pulled against the spring 4, and as a result, the operation rod 8 is pulled upwardly to close the throttle valve 2. In short, the throttle positioner 3 is kept in the "off" state while negative pressure is imposed on the pressure-operated chamber 5. Even at this point, namely at a low driving speed, if the accelerator pedal (not shown) is not pressed down, since an operation device (not shown) connected to said accelerating pedal has a higher power, the throttle valve 2 is, of course, opened regardless of the operation state of the throttle positioner 3. As is seen from the foregoing illustration, when the discharge pressure of the air pump 12 is lower than the prescribed value, the pressure control valve device 20 is kept in the "off" state and, in turn, both the EVAP system and the throttle positioner 3 are also kept in the "off" state.

When the discharge pressure of the air pump 12 exceeds the prescribed value, the pressure inside the pressure chamber 23 is increased and the diaphragm 28 is pushed upwardly against the spring 21, whereby the operation rod 25 fixed to this diaphragm 28 is moved upwardly and the valve head 26 becomes engaged with a stopper or valve seat 32 to open the valve port 34. Accordingly, air introduced from the air introduction inlet disposed below the charcoal canister 16 passes through the purge hose 14 while depriving the active carbon of the fuel vapor adsorbed thereon and is introduced into the chamber 24, and it then arrives at the valve port 34 through the opening 33 and valve chamber 31 and is brought into the intake pipe 11 through the conduit 9. At this point, the amount of fuel vapor brought into the suction pipe 11 together with the purged air is much smaller than the amount of fuel fed from a main nozzle (not shown) of the carburetor or from a slow port (not shown), and hence, it is construed that this fuel vapor will have no substantial influence on the prescribed air-fuel ratio. According to the preferred embodiment, however, the contracted portion 10 is formed in the conduit 9, and the amount of the fuel discharged through this conduit 9 is further reduced.

It will readily be understood that since a passage connecting the conduit 17 to the throttle positioner 3 does not form a flow circuit, even when the valve port 34 is opened, the purged air does not substantially flow through the conduit 17. The pressure in the operation chamber 5 of the throttle positioner 3 is made substantially equal to the purged air pressure, namely atmospheric pressure, through said conduit 17. In practice, however, because of the influence of the negative pressure in the intake pipe, the pressure in the chamber 5 is reduced to some extent, but the degree of the pressure reduction can be lessened by the provision of said contracted portion 10 in the conduit 9. Accordingly, the diaphragm 6 of the throttle positioner 3 is pressed down and the operation rod 8 is moved downwardly, whereby the throttle valve 2 is opened. In short, when the discharge pressure of the air pump 2 is higher than the prescribed value, both the EVAP system and the throttle positioner 3 are kept in the "on" state.

As seen from the foregoing explanation, according to the present invention, since both the EVAP system and the throttle positioner are simultaneously actuated and controlled by a single pressure control valve device utilizing the discharge pressure of the air pump, the structure of the control unit can be greatly simplified and hence, advantages such as lowering the manufacturing cost and reducing the weight of the car body can be attained.

Figure 3:
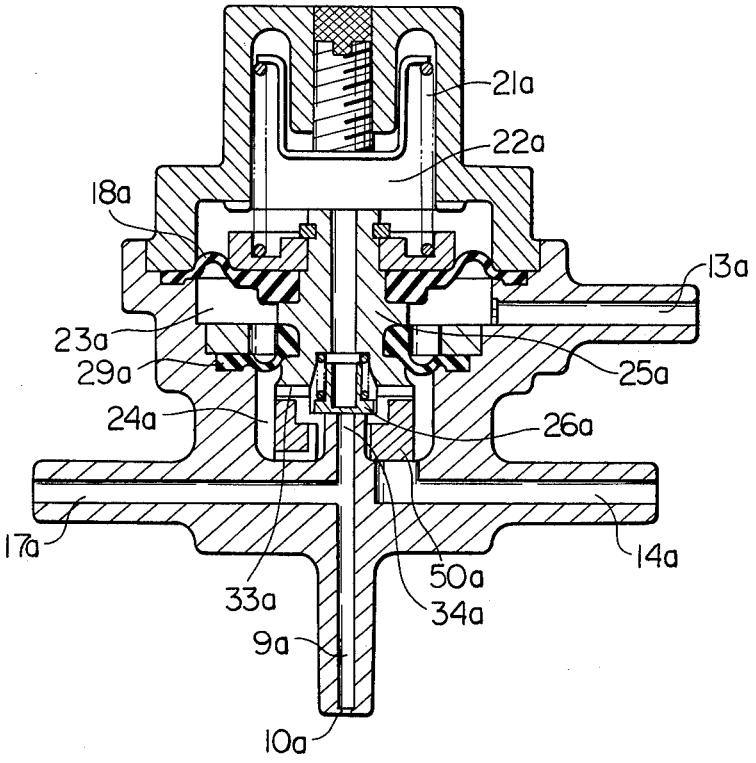
FIG. 3 is a sectional view illustrating a specific example of the actual design of the pressure control valve device shown in FIG. 2.

FIG. 3 illustrates a specific example of the actual design of the pressure control valve device 20 to be adapted to the control unit of the present invention. The operation of this device is substantially the same as that illustrated hereinabove with reference to FIG. 2. In FIG. 3 corresponding members are indicated by the same reference numerals as in FIG. 2 except that a is suffixed to each reference numeral in FIG. 3. In designing the device practically, a diaphragm **29*a* is used as the partition wall 29 in FIG. 2, and the chamber 23*a* is completely sealed. The operation rod 25*a* is hollow and the valve head portion 26*a* is engaged with the operation rod 25*a* through a spring. A member 50*a* is welded to the operation rod 25*a* and it is moved integrally with the operation rod 25*a*. The operation of the device shown in FIG. 3** will now be briefly described.

When the extrusion pressure of the air pump 12 (see FIG. 1) is imposed on the chamber **23*a* through a conduit 13*a*, the entire operation rod 25*a* is pushed upwardly against a spring 21*a* and hence, the valve head portion 26 is also moved upwardly to open a valve port 34*a*. As a result, a chamber 24*a* connected to the charcoal canister 16 (see FIG. 1) through a purge hose 14*a* is communicated with the valve port 34*a* through an opening 33*a* and the lower face of the member 50*a*. In short, when the valve port 34*a* is opened, the purge hose 14*a* is connected to the conduit 9*a* and the intended object is attained. In addition, the chamber 22*a* is always communicated with the purge hose 14*a* through the opening 33*a* and is always maintained at atmospheric pressure. When the valve port 34*a* is opened, the fuel vapor-containing purged air from the purge hose 14*a* is brought into the conduit 9*a* where negative pressure is maintained. Accordingly, this purged air does not substantially flow into the chamber 22*a***.

What I claim is:

1. A throttle valve control unit having a fuel evaporative emission control system comprising a pressure operative throttle positioner having pressure-operated chamber for opening and closing a throttle valve; a conduit connecting the throttle positioner to an intake pipe or manifold; an air pump for recombustion of the exhaust gas, driven by the engine; a pressure control valve connected to open and close according to the discharge pressure of the air pump; a charcoal canister; a purge hose connecting the canister to the throttle positioner through the pressure control valve device, said pressure control device being opened to connect said pressure-operated chamber to the pressure in the purge hose when the discharge pressure is lower than a prescribed value, whereby the throttle positioner is actuated to open the throttle valve and discharge purge air into the intake pipe or manifold.

2. A unit according to claim 1, wherein said pressure control valve device comprises three separate chambers, the first chamber being at approximately atmospheric pressure, the second being connected to said air pump to form a pressure chamber and the third having a valve chamber and being connected to said charcoal canister through the purge hose, said valve chamber being provided with a valve means which can be operated by the pressure from said air pump to open and connect the third chamber to the intake pipe or manifold thereby connecting the charcoal canister to the intake pipe or manifold to discharge the purge air containing the fuel vapor into the air-fuel mixture from a carburetor.

3. A unit according to claim 2, wherein at least one constricted portion is provided in a passage communicating said valve chamber, and accordingly, said third chamber with the intake pipe or manifold so that the purge air containing the fuel vapor can be discharged into the air-fuel mixture in the intake pipe or manifold, having substantially no effect on a predetermined air-fuel ratio.

4. A unit according to claim 2, wherein said first chamber and second chamber are divided by diaphragm means which can be operated by the discharge pressure from the air pump, said valve means comprises an operation rod which is fixed to said diaphragm means and extends through a partition wall between the second chamber and the third chamber into said valve chamber and valve head means to open and close a valve port connecting said third chamber to said intake pipe or manifold.

5. A unit according to claim 2, one end of said conduit extending from said pressure-operated chamber of the throttle positioner opens into the conduit connecting said valve chamber to the intake pipe or manifold.

* * * * *